US006623896B1

(12) United States Patent
Szajewski et al.

(10) Patent No.: US 6,623,896 B1
(45) Date of Patent: Sep. 23, 2003

(54) CAMERA SPEED COLOR FILM WITH EMULSION SIDE MICRO-LENSES

(75) Inventors: Richard P. Szajewski, Rochester, NY (US); Lyn M. Irving, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/167,746

(22) Filed: Jun. 12, 2002

(51) Int. Cl.[7] ..... G03C 1/765; G03C 7/14; G03C 3/00

(52) U.S. Cl. ..... 430/21; 430/383; 430/396; 430/496; 430/501; 430/503; 430/506; 430/946

(58) Field of Search ..... 430/21, 946, 496, 430/396, 503, 383, 501, 506

(56) References Cited

U.S. PATENT DOCUMENTS

| | | | | | |
|---|---|---|---|---|---|
| 992,151 | A | | 5/1911 | Berthon | 430/946 |
| 1,838,173 | A | | 12/1931 | Chretien | 430/946 |
| 2,143,762 | A | | 1/1939 | Capstaff | 430/946 |
| 2,191,038 | A | | 2/1940 | Capstaff | 430/946 |
| 3,530,779 | A | * | 9/1970 | Alofs | 430/946 |
| 3,676,130 | A | * | 7/1972 | Burkhardt et al. | 430/946 |
| 3,751,258 | A | * | 8/1973 | Howe et al. | 430/946 |
| 3,973,954 | A | * | 8/1976 | Bean | 430/946 |
| 4,272,186 | A | | 6/1981 | Plummer | 430/946 |
| 5,744,291 | A | | 4/1998 | Ip | 430/946 |
| 6,296,993 | B1 | * | 10/2001 | Sowinski et al. | 430/404 |
| 6,459,825 | B1 | * | 10/2002 | Lippincott | 382/312 |

* cited by examiner

*Primary Examiner*—Richard L. Schilling
(74) *Attorney, Agent, or Firm*—Arthur E. Kluegel

(57) ABSTRACT

Disclosed is a light sensitive photographic element comprising a support, a convergent micro-lens array, and an interposed light sensitive silver halide emulsion layer unit. Also disclosed is a camera combination and imaging method. Embodiments of the invention provide improved sensitivity and latitude in scene exposure range.

40 Claims, 4 Drawing Sheets

CAMERA SPEED COLOR FILM WITH EMULSION SIDE MICRO-LENSES

CROSS-REFERENCE TO RELATED APPLICATIONS

This application is being filed as one of a group of five cofiled and commonly assigned applications filed under Ser. Nos. 10/170,607, 10/171,012, 10/167,746, 10,167,794 and 10/170,148, the contents of which are incorporated herein by reference.

FIELD OF THE INVENTION

This invention relates to a light sensitive photographic element comprising a support, a convergent micro-lens array and an interposed light sensitive silver halide emulsion layer unit.

BACKGROUND OF THE INVENTION

In conventional photography, it is well known to record images by controllably exposing a photosensitive element to light from a scene. Typically, such a photosensitive element comprises one or more photosensitive layers supported by a flexible substrate such as film and/or a non-flexible substrate such as a glass plate. The photosensitive layers, which can have one or more light sensitive silver halide emulsions along with product appropriate imaging chemistry, react to the energy provided by the light from the scene. The extent of this reaction is a function of the amount of light received per unit area of the element during exposure. The extent of this reaction is greater in areas of the element that are exposed to more light during an exposure than in areas that are exposed to less light. Thus, when light from the scene is focused onto a photosensitive element, differences in the levels of light from the scene are captured as differences in the extent of the reaction in the layers. After a development step, the differences in the extent of the reaction in the layers appear as picture regions having different densities. These densities form an image of the original scene luminance.

It is characteristic of silver halide emulsions to have a non-linear response when exposed to ambient light from a scene. In this regard a photosensitive element has a lower response threshold that defines the minimum exposure at which the incorporated emulsions and associated chemistry begins to react so that different levels of exposure enable the formation of different densities. This lower threshold ultimately relates to the quantum efficiency of individual silver halide emulsion grains. Typically, all portions of a photosensitive element that are exposed to light at a level below the lower response threshold have a common appearance when the photosensitive element is developed.

Further, a photosensitive element also has an upper response threshold that defines the exposure level beyond which the emulsion and associated chemistries react so that different levels of exposure enable the formation of different densities. Typically, all portions of an element that are exposed at a level above the upper response threshold will again have a common appearance after the photosensitive element is developed.

Thus elements can be said to have both a lower response threshold and an upper response threshold which bracket a useful range of exposures wherein the element is capable of reacting to differences in exposure levels by recording a contrast pattern with contrast differences that are differentiable. The exposure levels associated with these lower and upper thresholds define the exposure latitude of the element.

To optimize the appearance of an image, therefore, it is typically useful to arrange the exposure so that the range of exposure levels encountered is within the latitude or useful range of the element.

It will be appreciated that many consumer and professional photographers prefer to use photosensitive elements, camera systems, and photography methods that permit image capture over a wide range of photographic conditions. One approach to meeting this objective is to provide photosensitive elements with wide latitude. However, extremely wide latitude photosensitive elements are fundamentally limited by the nature of the response of the individually incorporated silver halide grains to light. Accordingly, it is common to provide camera systems and photography methods that work to effectively extend the lower response limit and upper response limit of a photosensitive element by modifying the luminance characteristics of the scene. For example, it is known to effectively extend the lower response limit of the photosensitive element by providing supplemental illumination to dark scenes.

It is also known to increase the quantity of the light acting on a photosensitive element without providing supplemental illumination by using a taking lens system designed to increase the amount of light from the scene that is available to the photosensitive element to make an exposure possible. However, lenses that pass substantial light also inherently reduce the depth-of field of the associated camera system. This solution is thus not universally suitable for pictorial imaging with fixed focus cameras since scenes may not then be properly focused. This solution is also not preferred in variable focused cameras as such lens systems can be expensive, and difficult to design, install and maintain.

It will also be appreciated that there is a direct relationship between the duration of exposure and quantity of light from the scene that strikes the photosensitive element during an exposure. Accordingly, another way known in the art for increasing the amount of light acting on a photosensitive element during an exposure is to increase the duration of the exposure using the expedient of a longer open shutter. This, however, degrades upper exposure limits. Further, increased shutter open time can cause the shutter to remain open for a period that is long enough to permit the composition of a scene to evolve. This results in a blurred image. Accordingly, there is a desire to limit shutter open time.

Thus, what is also needed is a less complex and less costly camera system and photography method allowing the capture of images at action speed appropriate shutter times and particularly with cameras having a fixed shutter time.

Another way to increase the quantity of the light acting on a photosensitive element during an exposure is to use a conventional taking lens system to collect light from a scene and to project this light from the scene onto an array of micro-lenses such as an array of linear lenticular lenses that are located proximate to the film. An example of this is shown in Chretien U.S. Pat. No. 1,838,173. Each micro-lens concentrates a portion of the light from the scene onto associated areas of the film. By concentrating light in this manner, the amount of light incident on each concentrated exposure area of the photosensitive element is increased to a level that is above the lower response threshold of the film. This permits an-image to be formed by contrast patterns in the densities of the concentrated exposure areas.

Images formed in this manner are segmented: the concentrated exposure areas form a concentrated image of the scene and remaining portions of the photosensitive element form a pattern of unexposed artifacts in the concentrated image. In conventionally rendered prints of such images this pattern has an unpleasing low contrast and a half-tone look much like newspaper print. Thus, the micro-lens or lenticular assisted low light photography of the prior art is ill suited for use in high quality markets such as those represented by consumers and professional photographers.

However, micro-lens arrays, and in particular, lenticular arrays have found other applications in photography. For example, in the early days of color photography, linear lenticular image capture was used in combination with color filters as means for splitting the color spectrum to allow for color photography using black and while silver halide imaging systems. This technology was commercially employed in the first color motion picture systems as is described in commonly assigned U.S. Pat. No. 2,191,038. In the 1940s it was proposed to use lenticular screens to help capture color images using black and white photosensitive element in instant photography U.S. Pat. No. 2,922,103. In the 1970's, U.S. Pat. No. 4,272,185 disclosed the use of lenticular arrays to create images having increased contrast characteristics. By minimizing the size of the unexposed areas, the line pattern became almost invisible and was therefore less objectionable. Also in the 1970s, it was proposed to expose photosensitive element through a moving lenticular screen U.S. Pat. No. 3,954,334. Finally, in the 1990's linear lenticular-ridged supports having three-color layers and an antihalation layer were employed for 3-D image presentation materials. These linear lenticular arrays were used to form interleaved print images from multiple views of a scene captured in multiple lens camera. The interleaved images providing a three dimensional appearance. Examples of this technique is disclosed by Lo et al. in U.S. Pat No. 5,464,128 and by Ip, in U.S. Pat. No. 5,744,291. It is recognized that these disclosures relate to methods, elements and apparatus adapted to the formation of 3-D images from capture of multiple scene perspectives that are suitable for direct viewing. They fail to enable photography with shutter times suitable for use in hand-held cameras.

Thus, while micro-lens assisted photography has found a variety of uses, it has yet to fulfill the original promise of effectively extending the lower response threshold of a photosensitive element to permit the capture of commercially acceptable images at low scene brightness levels. What is needed, therefore, is a method and apparatus for capturing lenticular images on a photosensitive element and using the captured photosensitive element image to form a commercially acceptable print or other output.

It can also occur that it is useful to capture images under imaging conditions that are above the upper response threshold of the photosensitive element. Such conditions can occur with bright scenes that are to be captured under daylight, snow pack and beach situations. Typically, cameras use aperture control, shutter timing control and filtering systems reduce the intensity of light from the scene so that the light that confronts the photosensitive element has an intensity that is within the upper limit of the photosensitive element. However, these systems can add significant complexity and cost to the design of the camera. Further, the expedient of using a lens with a more open aperture to improve the lower threshold limit as discussed earlier simultaneously passes more light and degrades the exposure at the upper response threshold. Thus, what is also needed is a simple, less costly, camera system and photography method for capturing images over a range of scene brightness levels that is greater than the latitude of the photosensitive element.

It is a problem to be solved to provide a photographic element having improved sensitivity and latitude in scene exposure range.

SUMMARY OF THE INVENTION

The invention provides a light sensitive photographic element comprising a support, a convergent micro-lens array, and an interposed light sensitive silver halide emulsion layer unit.

The invention also provides a camera combination and imaging method. Embodiments of the invention provide improved sensitivity and latitude in scene exposure range.

DETAILED DESCRIPTION OF THE INVENTION

Figure 1:
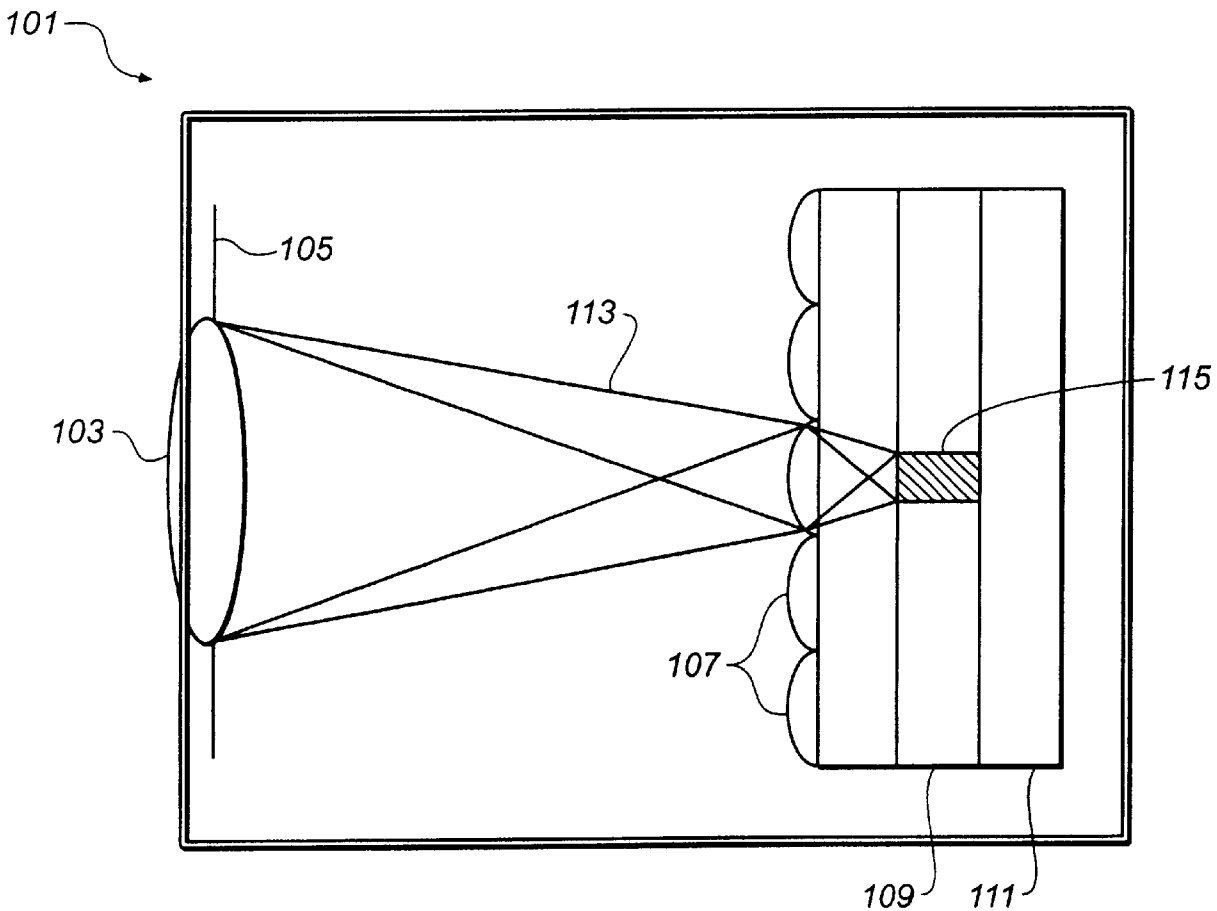
FIG. 1 schematically shows the exposure of a micro-lens photographic element in a camera.

An object of the invention is to provide high sensitivity silver halide elements useful for providing images under low light conditions. It is a further object of the invention to provide high sensitivity silver halide elements having reduced sensitivity to background radiation, improved shelf-keep and capable of recording images under a variety of illumination conditions. It is yet another object of this invention to provide silver halide elements having a wide exposure latitude.

The objects of the invention are met by providing a light sensitive photographic element comprising a support, a convergent micro-lens array, and an interposed light sensitive silver halide emulsion layer unit.

Scene information is imagewise exposed in spatially compressed and encoded form as patterns on light sensitive material during a taking phase by interposing micro-lenses in the exposure path. The micro-lenses act in conjunction with the silver halide to extend the effective image capture latitude of a photographic film by fracturing light from a scene to record a first exposure range and a second exposure range of light from a scene onto a film having a fixed exposure range so as to capture image information from scenes having a wider exposure range. The micro-lenses effectively enhance exposure in the first range and retard exposure in the second range. The imagewise exposed material is developed during a development phase to form a real image in compressed form. Useful images are formed by extraction of scene information by scanning and digital reconstruction.

In another useful readout path, the real image is reconstructed by reading through a micro-lens array. An appropriate field lens can be employed to adjust the plane at which the compressed pattern reforms a true image. The field lens thereby enables optical compatibility between taking and reading stages. Accordingly, the optically compressed and encoded information is optically reconstructed to reproduce the original scene content at a suitable and convenient imaging plane in a form that can be directly imaged onto a solid state sensor or a photosensitive material or directly visualized.

A micro-lens array is formed from multiple joined micro-lenses. The individual micro-lenses are convergent lenses in that they are shaped so as to cause light to converge or be focused. As such, they form convex projections from the film surface. The individual projections are shaped as portions of perfect or imperfect spheres. Accordingly, the micro-lenses can be spherical portion lenses or they can be aspherical portion lenses or both types of micro-lenses can be simultaneously employed. A spherical portion micro-lens has the shape and cross-section of a portion of a sphere. An aspherical portion micro-lens has a shape and cross-section of a flattened or elongated sphere. The lens are micro in the sense that they have a circular or nearly circular projection with a diameter of between 1 and 1000 microns. A cylindrical portion micro-lens has the shape and cross-section of a portion of a cylinder. An acylindrical portion micro-lens has a shape and cross-section of a flattened or elongated cylinder. The micro-lenses can be the same in focal length or aperture or they can vary in focal length or aperture. Providing a range of focal lengths enables fine focus at distinct layer units of the photographic element and increased element exposure latitude. Providing a range of apertures likewise enables increased exposure latitude. The micro-lenses can be arranged as a geometrically ordered array or they can be arranged as a geometrically non-ordered array. The micro-lenses can cover the entire support surface or they can cover only a portion of the element surface, again enabling increased exposure latitude. The micro-lenses can be permanent and survive the steps of photo chemical processing or they can be temporary and lose effect during photo-chemical processing. In a less preferred embodiment, cylindrical micro-lenses enabling enhanced latitude or being removable during photo-finishing can also be employed, although to lesser advantage.

The use of micro-lens arrays in image taking systems when combined with digital or photonic image reconstruction of recorded scene information enables photography under low light conditions typically beyond the scope of standard photographic techniques.

The method has special applicability to fixed-focus cameras, such as one-time-use cameras, since the system depth-of-field is controlled by the f-number of the camera lens while the effective system speed is controlled by the f-number of the micro-lens array. This allows very high-speed photography to be achieved with what would otherwise be considered low sensitivity emulsions in "slow" camera/lens systems having a large depth-of-field. Additionally camera manufacturability is improved because "slow" camera systems having a large-depth-of-field also have a large-depth-of-focus and can be manufactured economically to looser tolerances than can "fast" camera/lens systems with smaller depth-of-field and depth-of-focus characteristics. Further, the shelf-keeping, inspection insensitivity and radiation insensitivity of silver halide based images are improved since stable, low sensitivity silver halide emulsion grains can be gainfully employed. The elements of the invention are further capable of recording images under a wide range of illuminant levels.

This invention provides photography systems and photography methods that extend the effective image capture latitude of a photographic film by fracturing light from a scene to record a first exposure range and a second exposure range of light from a scene onto a film having a fixed exposure range so as to capture image information from scenes having a wider exposure range. This invention further provides methods for recovering an acceptable output image from the imaging information recorded on the film.

On exposure, light is fractured into a pattern of concentrated fractions and unconcentrated fractions. Light concentration is enabled by the beads acting as lenses. The concentrated fractions of the light expose a first area on the film and form a pattern of dots on the film after development and according to the geometric characteristics of the micro-lenses, when the light from the scene is within a first exposure range. The unconcentrated fractions expose a second area of the film so that the film can record imaging information from an exposure that is within a second range wherein the first exposure range and second exposure range together are greater than the predetermined range of the film. The film is then photo-processed. Any art know photo-processing can be employed. The photo-processing can comprise a development step with optional desilvering steps. The photo-processing can be by contacting the film with photo-processing chemicals or art know agents enabling photo-processing. The photo-processing can be by contacting the film with aqueous solutions of photo-processing chemicals or pH adjusting agents or both. Alternatively, the film can be an art known photothermographic film that is photo-processed by heating or by a combination of contacting with photo-processing enabling agents and heat. After photo-processing a determination is made as to whether an image recorded on the film contains an image formed by hyper exposure, on an image formed by hypo-exposure or some combination thereof. The film is scanned and the scanned image is processed to recover an image based upon image data from either or both of the hyper exposed areas or the hypo exposed areas. The output image is optionally further improved and processed for its intended use.

A camera system useful for fracturing scene light and forming images on a film includes a taking lens system that focuses light from a scene onto a film and interposed between taking lens system and film is a micro-lens array.

Each lens in the micro-lens array receives a portion of the light passing from the taking lens system and fractures this light into a compressed fraction and an uncompressed fraction. The concentration is achieved because each lens of the micro-lens array has a predetermined cross sectional area. Light from the image strikes this predetermined cross sectional area and a fraction of the light incident on the lens is concentrated. This concentrated fraction of light is directed onto a first exposure area of film having a smaller cross section than that of lens. This increases the effective exposure level on the film in the first exposure area and permits the emulsion to react to form an image. However, some of the light incident on the lenses, or light that is poorly focused by the lenses or light that is scattered is not concentrated onto the first exposure area. Instead, this unconcentrated fraction of the light passes to film without substantial concentration and is incident on second exposure area enabling formation of a surround image therein. This unconcentrated fraction of light is less than the amount of light that would be incident on film in the event that the micro-lens array was not interposed between the scene and the film during the same exposure. Thus, the micro-lens array effectively filters light from the scene that is incident on second area so that a greater quantity of light must be available during the exposure in order for an image to be formed on the film. Accordingly, the micro-lens array shields light within a second exposure range to create a second exposure suitable for producing a differentiable image over the range indicated by second image range on film. It will be appreciated that the upper and lower limits of the second exposure range are within the actual film latitude and therefore, can be recorded on film. This effectively extends the upper exposure threshold of film. It will be further appreciated that, while this discussion has been framed in terms of a specific embodiment directed towards silver halide photography intended for capturing human visible scenes, the invention can be readily applied to capture extended scene luminance ranges and spectral regions invisible to humans, and the light sensitive material can be any light sensitive material known to the art that has the requisite imaging characteristics. The effective increase in latitude enabled can be at least 0.15 log E, while it is preferably at least 0.3 log E, more preferably at least 0.6 log E and most preferably at least 0.9 log E.

In a useful imaging system a camera lens and micro-lens array jointly image a scene onto the light sensitive material. The light concentration or useful photographic speed gain on concentrating light with a spherical or aspherical portion micro-lens is the square of the ratio of the two lens f-number's. Speed gain (in log rel. E)=2×log (camera lens f-number/micro-lens f-number). The less preferred cylindrical portion micro-lenses allow only the square root of such an improvement because they concentrate light in only one direction. The concentration of light by the preferred micro-lens array enables both a system speed gain and forms a dot pattern on the light sensitive material. The dimensions of the camera and the detailed characteristics of the camera lens dictate the exposure pupil to image distance, i.e. the camera focal length. The camera image is formed at the micro-lenses. The micro-lens characteristics dictated the micro-lens focal length and the micro-lens images are formed at the light sensitive layers. The camera lens f-number controls the depth-of-focus and depth-of-field of the camera while the micro-lens f-number controls the effective aperture of the camera. By using a stopped down f-number for the camera lens, excellent sharpness along with wide depth of focus and depth of field are obtained. By using an opened f-number for the micro-lenses, high system speed is obtained with emulsions that are typically thought of as "slow." This extra speed allows available light photography without the thermal and radiation instability typically associated with "fast" emulsions. Accordingly, a useful combination of camera lens and micro-lens f-number's will be those that enable system speed gains. System speed gains of 0.15 log E, or ½-stop, are useful while system speed gains of at least of 0.2 log E are preferred, 0.3 log E more preferred, 0.5 log E even more preferred and 0.8 log E or more especially preferred. While any micro-lens f-number that enables a speed gain with a camera lens having adequate depth-of-field for an intended purpose can be gainfully employed, typically micro-lens f-number's of 1.5 to 16 are useful, while micro-lens f-number's in the range of f/2 to f/7 are preferred and micro-lens f-number's in the range of f/3 to f/6 are more preferred.

While any useful surface coverage of micro-lenses, can be employed, the ratio of the projected area of the micro-lenses to the projected area of the photographic element, or film, can be at least 20 percent, preferably at least 30 percent, more preferably at least 50 percent, even more preferably at least 70 percent, and up to 80 percent or 95 percent or even at the close-packed limit. The precise degree of surface coverage can be adjusted to enable increased exposure latitude while maintaining useful photographic graininess and sharpness. It will be appreciated that adjusting the surface coverage can be a method of partitioning light between the described first exposure range and second exposure range and an undisturbed range coincident with the natural exposure range of the light sensitive material. Accordingly, it can be preferred that the fill-factor be less than 95%, or more preferred that it be less than 90% or even more preferred that it be less than 85% or even less than 75%.

While any useful number of micro-lenses can be employed per image frame to achieve the desired results, it is recognized that the actual number to be employed in any specific configuration depends on the configuration. For example, when a desired micro-lens focal length is fixed by forming integral micro-lenses on the support side of a photographic material and the micro-lens f-number is fixed by the desired system speed gain for the combined lens system, micro-lens apertures or pitches of 10 to 100 microns can be encountered. So, a 135-format frame, roughly 24 by 36 mm in extent, can have between about 86 thousand and 8.6 million micro-lenses at full surface coverage. Emulsion side micro-lenses, with their shorter focal-length can have useful apertures or pitches between about 3 and 30 microns which means roughly 960 thousand to 96 million micro-lenses per 135-format frame at full surface coverage. Camera mounted micro-lenses with their greater freedom in focal lengths can range up to 500 microns or even larger in aperture or pitch.

FIG. 1 illustrates a camera 101 having a taking lens 103, an aperture stop 105, and a light sensitive element. The element has a support 111, a micro-lens array 107 and an interposed light sensitive layer unit 109. Other camera elements such as a shutter and release, film reels and advance mechanisms, viewfinders and such are omitted for clarity. On imagewise exposure in the camera the interposed micro-lens array acts to concentrate the light falling on specific portions of the light sensitive element, rays shown as 113, thus effectively increasing the system sensitivity of the camera while producing a dot or line exposure pattern, one portion shown as 115, on the light sensitive element. The camera lens and micro-lens array jointly image a scene onto the light sensitive material. The light concentration or useful photographic speed gain on concentrating light with a spherical or aspherical portion micro-lens is the square of the ratio of the two lens f-number's. The concentration of light by the preferred micro-lens array enables both a system speed gain and forms a compressed pattern on the light sensitive material. The figure shows an integral micro-lens array as part on the emulsion side of photographic material. This configuration can be made by embossing micro-lenses into a gelatin overcoat. Unhardened gelatin can be especially useful in this regard. Other configurations include applying pre-formed micro-lenses to the emulsion side of a conventional photographic material. The dimensions of the camera and the detailed characteristics of the camera lens dictate the exposure pupil to image distance. In this figure, the exposure pupil position or aperture position is roughly coincident with the camera lens. The camera lens f-number controls the depth-of-focus and depth-of-field of the camera while the micro-lens f-number controls the effective aperture of the camera. By using a stopped down f-number for the camera lens, excellent sharpness along with wide depth of focus and depth of field are obtained. By using an opened f-number for the micro-lenses, high system speed is obtained with emulsions that are typically thought of as "slow." This extra speed allows available light photography without the thermal and radiation instability typically associated with "fast" emulsions.

Figure 2:
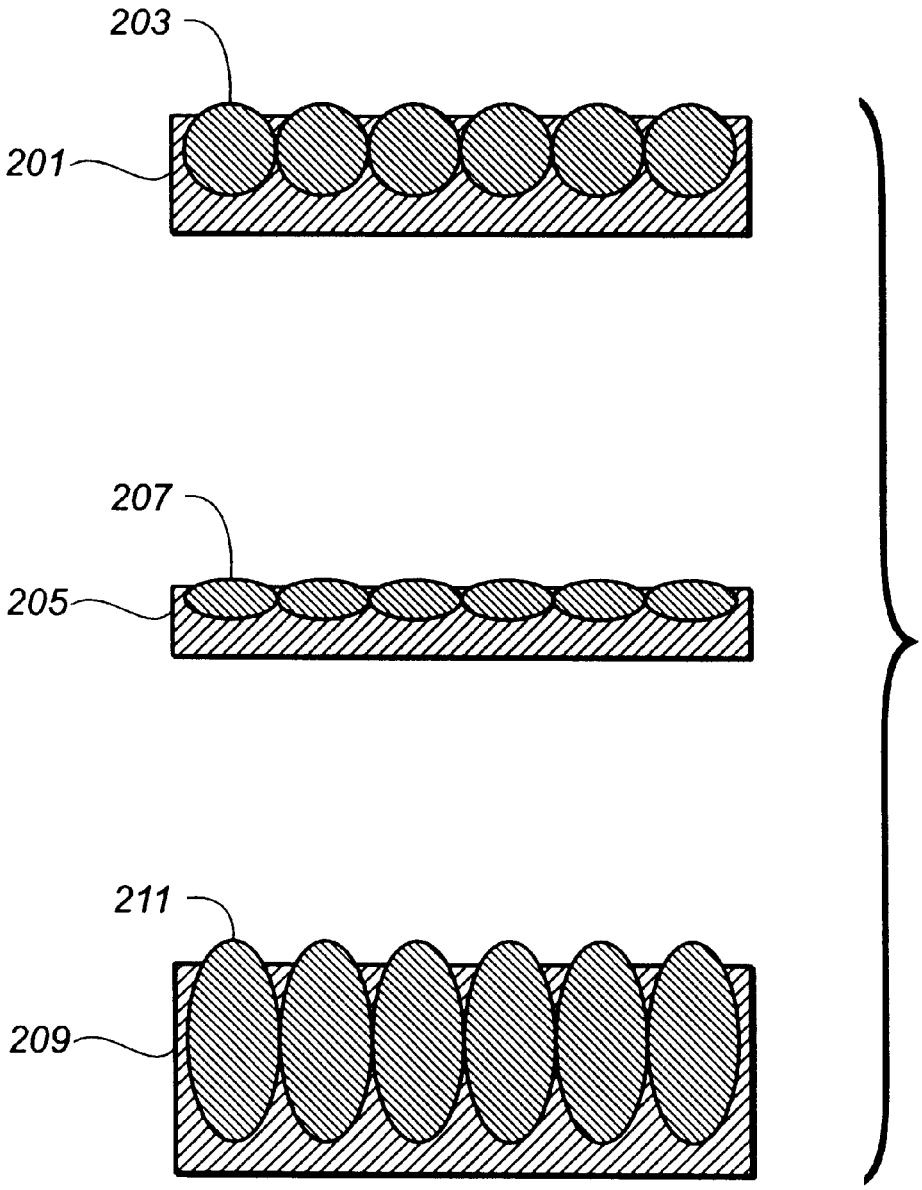
FIG. 2 schematically shows a side view of of spherical and aspherical micro-lenses.

FIG. 2 illustrates a portion of a photographic element 201 with spherical portion micro-lenses 203. The lenses are shown with distinct hatching to illustrate the spherical character of the protruding portion that actually forms the micro-lens. The micro-lenses may be formed in any matter known in the microstructure art. These lenses may be unitary with the element, as for example by being embossed directly into the material at manufacture or they may be integral to a distinct layer applied to the element. The micro-lenses can be sufficiently permanent to survive photochemical processing with retained structure and function or can be changed during photochemical processing in a manner that alters their structure and function. A cast or embossed hardened gelatin layer or a high Tg or non-photochemical soluble polymeric layer provide an examples of a permanent micro-lens structure, while a cast or embossed unhardened gelatin layer or a low Tg or photochemical soluble polymeric layer provide examples of a photo-processing alterable micro-lens structure. FIG. 2 further illustrates a photographic element support 205 with aspherical portion micro-lenses 207, and another support 209 with distinct aspherical micro-lenses. The lenses are shown with distinct hatching to illustrate the spherical character of the protruding portion that actually forms the micro-lens. The aspherical micro-lenses are especially useful for this application in that the variable radius of such lenses allows for control of the lens focal length and lens aperture nearly independently of the spacing between the micro-lenses and the light sensitive layers. While these cross-sections have been described as spherical or aspherical, it is fully appreciated that the diagrams equally represent in cross-section cylindrical or acylindrical micro-lenses. The known formation of micro-lenses on a support and the strict relationship between support thickness, micro-lens aperture, micro-lens radius and micro-lens focal length is a major shortcoming of historic applications of lenticular photography.

Figure 3:
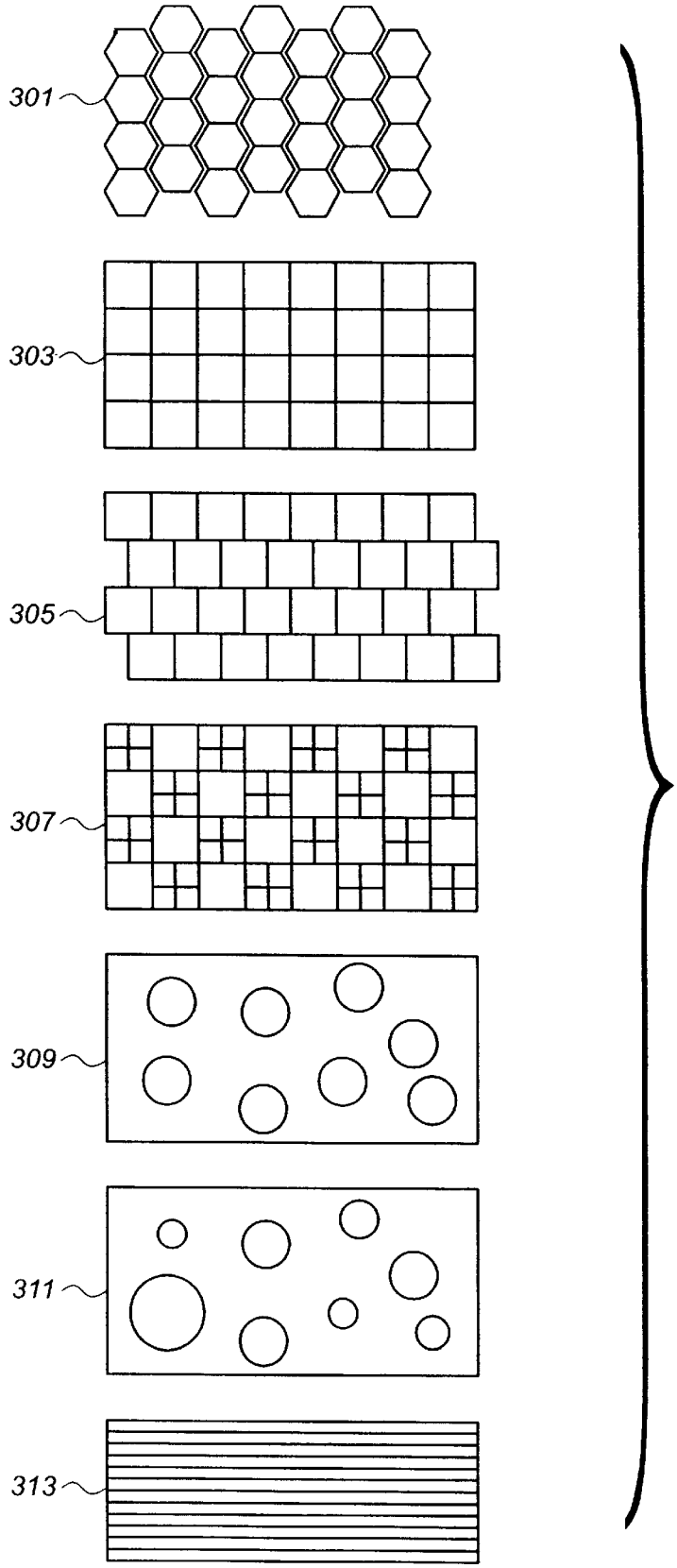
FIG. 3 shows a face view of symmetric and asymmetric micro-lens patterns.

FIG. 3 illustrates face views of several useful patterns of spherical micro-lenses. A hexagonal close-packed array pattern is shown as 301. A regular square close-packed array pattern is shown as 303. An off-set square close packed array pattern is shown as 305. A close packed square array pattern having areas of distinct aperture or focal length is shown as 307. A random non-close packed array is shown as 309. A random non-close packed array-having regions of distinct aperture or focal length is shown as 311. Diagrams 301 through 307 relate to spherical or aspherical micro-lenses. It is appreciated that any of these patterns may be combined with aspherical micro-lenses to provide extended latitude to the underlying photographic layers. Further, any of the micro-lens patterns can be applied in a non-close packed manner to again enable extended photographic latitude. Cylindrical or acylindrical micro-lenses are illustrated in as 313. Again, variable aperture, focal length and width patterns are contemplated. While any surface coverage of micro-lenses can be employed, the ratio of the projected area of the micro-lenses to the projected area of the photographic element can be at least 20 percent, preferably at least 30 percent, more preferably at least 50 percent, even more preferably at least 70 percent, and up to 80 percent or 95 percent or even at the close-packed limit. The precise degree of surface coverage can be adjusted to enable varying levels of exposure latitude while maintaining useful photographic graininess and sharpness.

Figure 4:
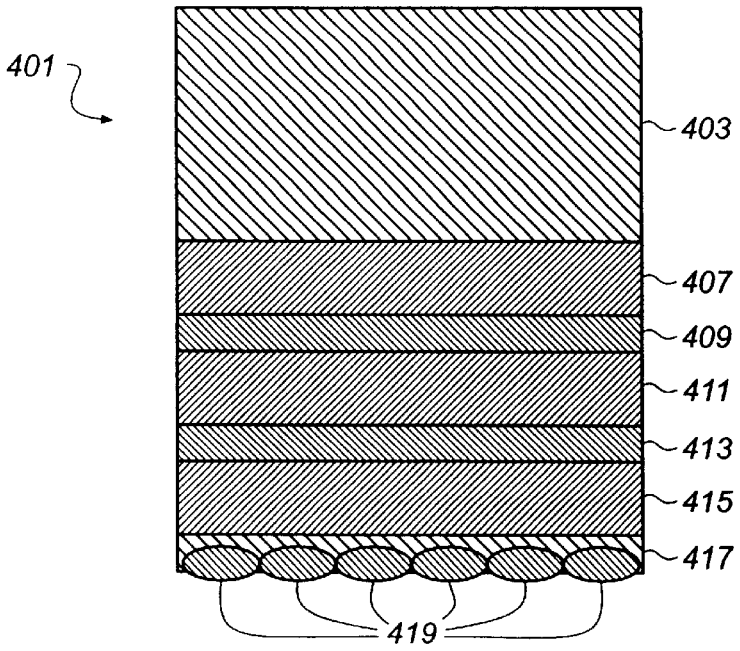
FIG. 4 shows micro-lenses on a support with interposed light sensitive silver halide layers.

FIG. 4 illustrates further details of a light sensitive element with light sensitive silver halide layers interposed between micro-lenses and a support. Here the photographic element 401 comprises a support 403. The support bears a red light sensitive color forming unit 407, a green light sensitive color forming unit 411 and a red light sensitive color forming unit 415 with interlayers 409 and 413 and protective overcoat 417. The protective overcoat 417 further includes micro-lenses 419. The interlayers and auxiliary layers (not shown) can further comprise dyes, stabilizers and scavengers as known in the art. The color forming units can comprise one or more layers as known in the art. In another embodiment, not shown, the color forming layers can be replaced by one or more ortho or pan sensitized layers to form a black and white recording material.

Figure 5:
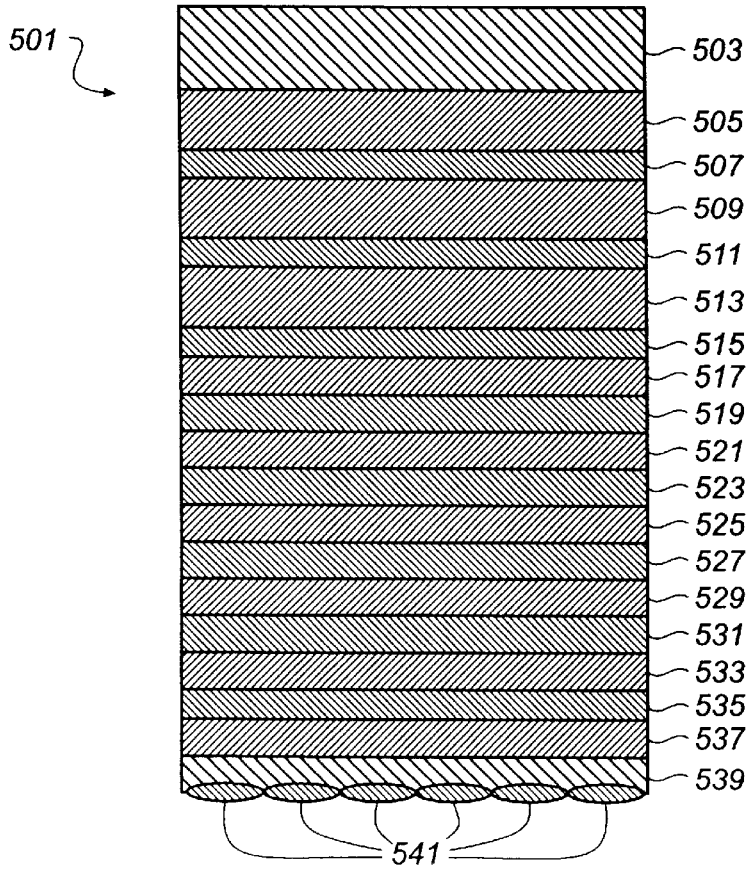
FIG. 5 shows another embodiment of micro-lenses on a support with interposed light sensitive silver halide layers.

FIG. 5 illustrates further details of a light sensitive element 501 with micro-lenses 541 and interposed the light sensitive layers. Here, a layer arrangement useful for very high speed, extended latitude photography has a most blue sensitive layer 537, a most green sensitive layer 533, a most red sensitive layer 529, a less blue sensitive layer 525, a least blue sensitive layer 523, a more green sensitive layer 519, a less green sensitive layer 517, a least green sensitive layer 515, a more red sensitive layer 511, a less red sensitive layer 509 , a least red sensitive layer 507, a UV and light absorbing a protective layer 539 bearing the micro-lenses, and interlayers 513, 521, 527, 531, and 535. The interlayers, along with art known subbing layers and auxiliary layers (not shown) can further comprise dyes, stabilizers and scavengers as known in the art.

Useful parameters for micro-lenses and their relationship to the light sensitive layers of a photographic element follow from these definitions:

Micro-lens radius is the radius of curvature of the spherical portion shaped protrusion of micro-lens. For aspherical micro-lenses this value varies across the surface of the micro-lens.

Micro-lens aperture is the cross sectional area formed by the micro-lens typically described as a diameter. For spherical micro-lenses this diameter is perforce less than or equal to twice the micro-lens radius. For aspherical micro-lenses this diameter can be greater than twice the smallest radius encountered in the micro-lens. Use of differently sized micro-lenses having distinct apertures enables distinct levels of speed gain on a micro-scale and thus enables extended exposure latitude for a photographic layer.

Micro-lens focal length is the distance from micro-lens to photosensitive layers. For micro-lenses on the opposing side of a support relative to a light sensitive layer this is typically set to be about the thickness of the support. It is appreciated that use of micro-lenses enables distinct color records to be preferentially enhanced for sensitivity. This feature can be especially important in specific unbalanced lighting situations such as dim incandescent lighted interiors that are blue light poor and red light rich. For example, for cameras and films intended for use in incandescent lighted environments, the micro-lenses can be designed to preferably focus on the blue light sensitive layers, thereby providing a larger boost in the blue light regime and enabling a more color-balanced situation. Other colors can be likewise advanced as desired.

Micro-lens f-number is the micro-lens aperture divided by the/micro-lens focal-length.

For spherical micro-lenses, the desired micro-lens focal length can be used to define an appropriate micro-lens radius following a lens equation. The micro-lens radius is the micro-lens focal-length times $(n_2-n_1)/n_2$ where $n_1$ is the refractive index of the material outside the micro-lens (typically air with a refractive index of unity) while $n_2$ is the refractive index of the micro-lens and appended photographic material (plastics as used in photographic supports and photographically useful gelatin typically have a refractive index of 1.4 to 1.6). Superior optical properties are provided when the refractive index of the materials used to form a micro-lens, the photographic support and the binder for the light sensitive layers are as similar as possible. It is preferred that the ratio of the highest to the lowest refractive be between 0.8 and 1.2, more preferred that the ratio be between 0.9 and 1.1, and even more preferred that the ratio be between 0.95 and 1.05. However, purposeful mismatches in refractive index can facilitated light scatter and reflection and thereby influence the extent of residual image formation.

Following the know refractive indices of typical photographic system components, useful spherical micro-lenses will have a micro-lens focal length about 3 times the micro-lens radius ($(n_2-n_1)/n_2 \sim 1/3$). In this context, it is appreciated that aspherical micro-lenses enable a greater degree of design flexibility in adjusting micro-lens aperture and focal length to the other requirements of photographic materials.

The materials useful in forming the light sensitive layers and the photographic support useful the invention are those known in the art. They can be employed in any of the ways and in any of the combinations known in the art. Typically, the materials are incorporated in a melt and coated as a layer described herein on a support to form part of a photographic element. When the term "associated" is employed, it signifies that a reactive compound is in or adjacent to a specified layer where, during processing, it is capable of reacting with other components.

Unless otherwise specifically stated, use of the term "group", "substituted" or "substituent" means any group or atom other than hydrogen. Additionally, when reference is made in this application to a compound or group that contains a substitutable hydrogen, it is also intended to encompass not only the unsubstituted form, but also its form further substituted with any substituent group or groups as herein mentioned, so long as the substituent does not destroy properties necessary for the intended utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl, or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; atyloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy) acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl, acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Other art recognized combinations of spectral sensitivity and color formation can be employed. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, Research Disclosure, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777 and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094;

4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in amole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019,492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378, 236; 384,670; 396,486; 401,612; 401,613.

Such compounds are also disclosed in "Developer-Inhibitor-Releasing (DIR) Couplers for Color Photography," C.R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

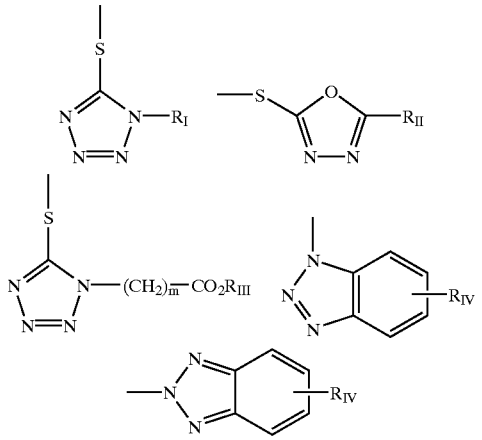

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

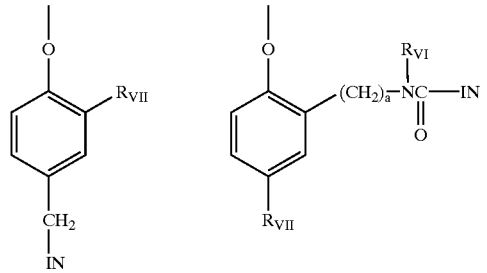

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

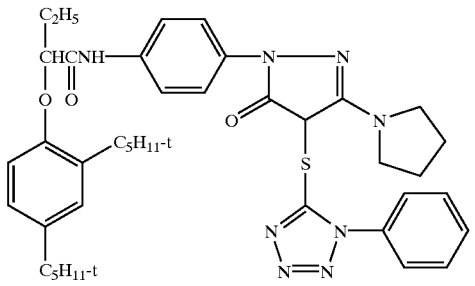

-continued
D2
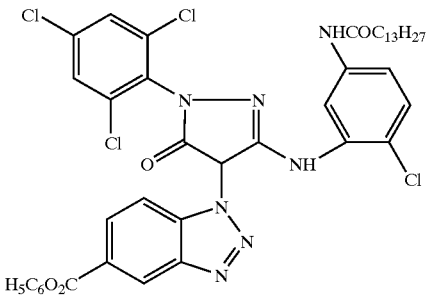
D3
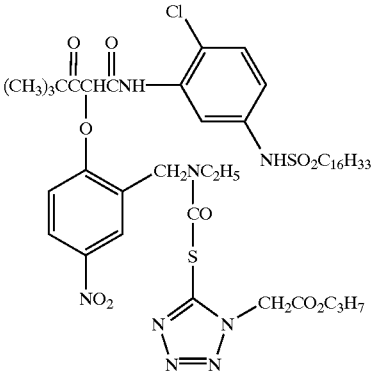
D4
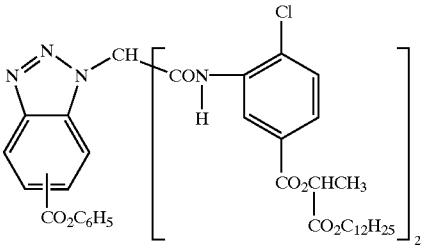
D5
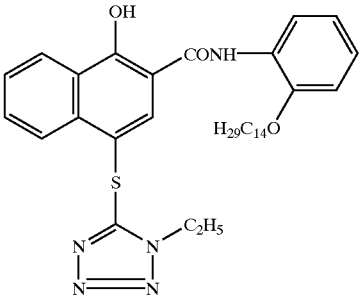
-continued
D6
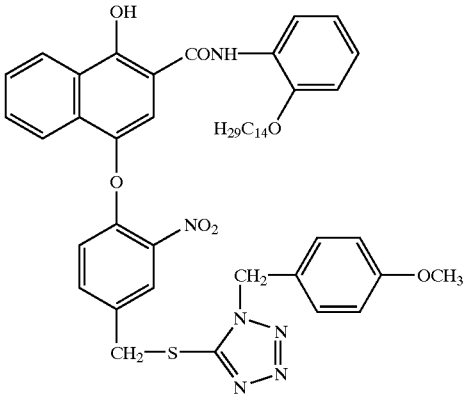
D7
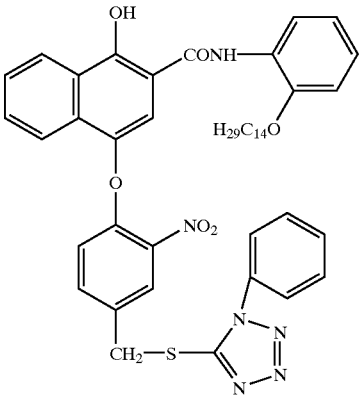
D8
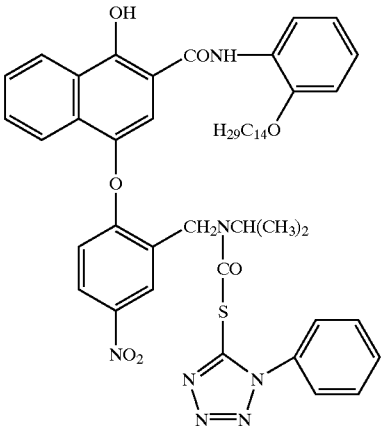
D9
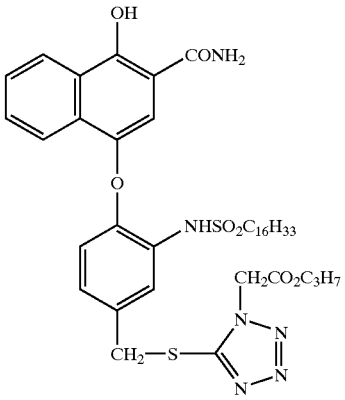

-continued

D10

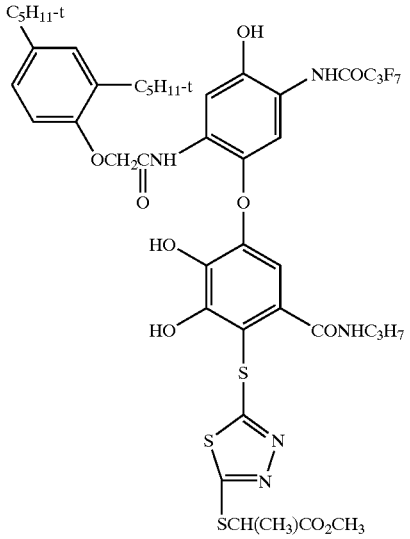

D11

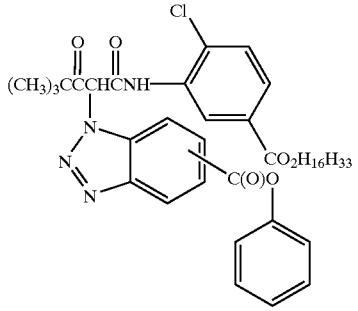

D12

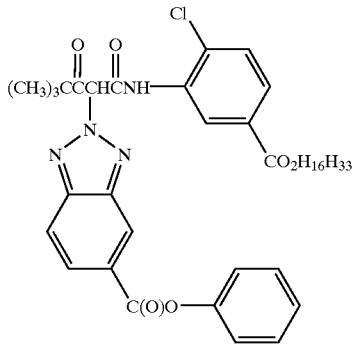

It is also contemplated that the present invention may be employed to obtain reflection materials as described in *Research Disclosure*, November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region-of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

Elements having excellent light sensitivity are best employed in the practice of this invention. The elements should have a sensitivity of at least about ISO 25, preferably have a sensitivity of at least about ISO 100, and more preferably have a sensitivity of at least about ISO 400. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number pH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

While standard photographic elements can be employed in this invention, the elements most useful in this invention are designed for capturing an image in machine readable form rather than in a form suitable for direct viewing. In the capture element, speed (the sensitivity of the element to low light conditions) is usually critical to obtaining sufficient image in such elements. Accordingly, the elements, after micro-lens speed enhancement will typically exhibit an equivalent ISO speed of 800 or greater, preferable an equivalent ISO speed of 1600 or greater and most preferably an equivalent ISO speed of 3200 or greater.

The elements will have a latitude of at least 3.0 log E, and preferably a latitude of 4.0 log E, and more preferable a latitude of 5.0 log E or even higher in each color record Such a high useful latitude dictates that the gamma of each color record (i.e. the slope of the Density vs log E after photoprocessing) be less than 0.70, preferably less than 0.60, more preferably less than 0.50 and most preferably less than 0.45. Further, the color interactions between or interimage effects are preferably minimized. This minimization of interimage effect can be achieved by minimizing the quantity of masking couplers and DIR compounds. The interimage effect can be quantified as the ratio of the gamma of a particular color record after a color separation exposure and photoprocessing divided by the gamma of the same color record after a white light exposure. The gamma ratio of each color record is preferably between 0.8 and 1.2, more preferably between 0.9 and 1.1 and most preferably between 0.95 and 1.05. Further details of the construction, characteristics quantification of the performance of such scan enabled light sensitive elements and are disclosed in Sowinski et al. U.S. Pat Nos. 6,021,277 and 6,190,847, the disclosures of which are incorporated by reference.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Additionally, the ability to provide rapid and convenient photo processing is greatly facilitated by employing a film designed for easy photofinishing. A dry process film is such a film. In one embodiment, a dry-process film can be characterized as a light sensitive silver halide film having an incorporated developer in a binder on a support and capable of forming a differentiable machine-readable image consisting of a non-diffusible dye by the application of heat. In another embodiment, a dry-process film can be characterized as a light sensitive silver halide film capable of forming a differentiable machine-readable image consisting of a non-diffusible dye by the application of little to no processing solvent and a laminate layer where the dry-process film or the laminate layer has an incorporated developer. In yet another embodiment, a dry-process film can be one characterized as a light sensitive silver halide film capable of forming a differentiable machine-readable image consisting of a non-diffusible dye by the application of developer in limited quantities of processing solvent. Dry process films, photo-processes and photo-processors are well know in the art. Any of these can be usefully employed. Particularly suitable dry-process films and suitable components are described by Irving et al, U.S. Pat. No. 6,242,166, by Szajewski, et al, U.S. Pat. No. 6,048,110, by Ishikawa et al U.S. Pat. Nos. 5,756,269 and 5,858,629, by Ishikawa, U.S. Pat. No. 6,022,673, by Kikuchi, U.S. Pat. Nos. 5,888,704 and 5,965,332, by Okawa, et al, U.S. Pat. No. 5,851,749, by Takeuchi, U.S. Pat. No. 5,851,745, by Makuta et al, U.S. Pat. No. 5,871,880, by Morita, et al, U.S. Pat. No. 5,874,203, by Asami et al, U.S. Pat. No. 5,945,264, by Kosugi et al, U.S. Pat. No. 5,976,771, and by Ohkawa et al, U.S. Pat. No. 6,051,359.

The films of the invention can be provided as sheets or spooled for easy loading in cameras. This typically is accomplished by slitting the cast films to an appropriate width, chopping the film to an appropriate length, edge-perforating the film to enable proper mechanical transport, providing informational mechanical, magnetic or exposure marking as part of manufacture and spooling the film on a spool. A spool minimally has a core for supporting the film. The spool can additionally have other art known structures. The photographic element of the invention can be incorporated into exposure structures intended for repeated use or exposure structures intended for limited use, variously referred to by names such as "single use cameras", "lens with film", or "photosensitive material package units".

Since a specific spatial arrangement of camera lens, micro-lens and light sensitive layers is required for the invention, care must be taken with the direction of spooling and loading of film elements into a camera for imagewise exposure and in photo-processing the imagewise exposed film. When the micro-lens, light sensitive layers and flexible support components of an integral light sensitive unit according to the invention are arranged with the light sensitive layers between the micro-lenses and the support (type A), then the integral light sensitive unit can be spooled and optionally mounted in a cartridge, cassette or otherwise with the micro-lens side wound side-in to a spool so as to be fully compatible with common cameras, photo-processing units and scanners, optical printers and such. However, when the micro-lens, light sensitive layers and flexible support components of an integral light sensitive unit according to the invention are arranged with the support between the micro-lenses and the light sensitive layers (type B), then the integral light sensitive unit can be spooled and optionally mounted in a cartridge, cassette or otherwise with the micro-lens side wound side-in to a spool or wound side-out to a spool with distinct ancillary requirements for cameras, photo-processing units and scanners. When a type B integral light sensitive unit is spooled with the integral micro-lenses wound side-in, then the spooled unit can be loaded and imagewise exposed in a normally configured camera body. However, photoprocessing, scanning or optical printing are facilitated by a face-to face reversal, i.e. a 180 degree twist, of the integral film so as to allow easy access of photoprocessing agents to the light sensitive layers and to ensure proper optics and scene direction during scanning or printing with commonly designed photoprocessing, scanning or printing units. Alternatively, the photoprocessing, scanning or printing units can be re-designed to accept these reverse wound spools. When a type B integral light sensitive unit is spooled with the integral micro-lenses wound side-out, then the spooled unit can be loaded and imagewise exposed in re-configured camera body. The camera body is re-configured so that the light from the camera lens strikes the micro-lenses before reaching the light sensitive layers. Here photoprocessing, scanning or optical printing are as commonly provided.

The scanning step can be performed in any number of conventional manners using film scanner. In one preferred embodiment, the image is scanned successively within blue, green, and red light within a single scanning beam that is divided and passed through blue, green and red filters to form separate scanning beams for each color record. If other colors are imagewise present in film, then other appropriately colored light beams can be employed. Alternatively, when a monochromatic color forming material is employed, that material can be scanned and treated as such. As a matter of convenience, the ensuing discussion will focus on the treatment of color forming materials. In one embodiment, a red, green and blue light are used to retrieve imagewise recorded information and film is further scanned in infrared light for the purpose of recording the location of non-image imperfections. When such an imperfection or "noise" scan is employed, the signals corresponding to the imperfection can be employed to provide a software correction so as to render the imperfections less noticeable or totally non-noticeable in soft or hard copy form.

In another embodiment, the formed image is scanned multiple times by a combination of transmission and reflection scans, optionally in infrared and the resultant files combined to produce a single file representative of the initial image.

Elements having calibration patches derived from one or more patch areas exposed onto a portion of unexposed photographic material can be usefully employed.

The scanning can be performed at a spatial pitch that is coarser than the spatial pitch of the fractured image thereby under-sampling the fractured image. In another embodiment, the scanning can be performed at a spatial pitch that is finer than the spatial pitch of the fractured image thereby over-sampling the fractured image. In yet another embodiment, can be performed at a spatial pitch that matches than the spatial pitch of the fractured image thereby recording the fractured image.

Image data can also be processed after scanning to ensure the fidelity of color data in advance of the recovery of image information from the dots or the interdot area. The signal transformation techniques disclosed can be further modified so as to deliver an image that incorporates the look selected by a customer as described by Szajewski et al in EP 1164 778 and EP 1182 858, the disclosures of which are incorporated by reference. Matrices and look-up tables (LUTs) can provide useful image transformation.

In one variation, the R, G, and B image-bearing signals from scanner are converted to an image metric which corresponds to that from a single reference image-recording device or medium and in which the metric values for all input media correspond to the trichromatic values which would have been formed by the reference device or medium had it captured the original scene under the same conditions under which the input media captured that scene. In another variation, if the reference image recording medium was chosen to be a specific color negative film, and the intermediary image data metric was chosen to be the predetermined R', G', and B' intermediary densities of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the actual color negative recording material was exposed. The result of such scanning is digital image data that is representative of the image that has been captured on film.

It is to be appreciated that while the image is in electronic or digital form, the image processing is not limited to the specific manipulations described above. While the image is in digital form, additional image manipulation may be used including, but not limited to, scene balance algorithms (to determine corrections for density and color balance based on the densities of one or more areas within the processed film), tone scale manipulations to adjust film underexposure gamma or overexposure gamma non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations as known in the art.

Once the image has been corrected and any additional image processing and manipulation has occurred, the image may be electronically transmitted to a remote location or locally written to a variety of output devices including, but not limited to, film recorder, printer, thermal printers, electrophotographic printers, ink-jet printers, display, CD or DVD disks magnetic electronic signal storage disks, and other types of storage devices and display devices known in the art. Besides digital manipulation, the digital images can be used to change physical characteristics of the image, such as "windowing" and "leveling" or other manipulations known in the art. Further, output image-bearing signals can be adapted for a reference output device, can be in the form of device-specific code values or can require further adjustment to become device specific code values. Such adjustment may be accomplished by further matrix transformation or look-up table transformation, or a combination of such transformations to properly prepare the output image-bearing signals for any of the steps of transmitting, storing, printing, or displaying them using the specified device.

The entire contents of the patents and other publications referred to in this specification are incorporated herein by reference.

PARTS LIST

101. Camera
103. Camera taking lens
105. Aperture stop
107. Micro-lenses
109. Light sensitive unit
111. Support
113. Lightrays
115. Exposure pattern
201. Support
203. Spherical portion micro-lenses
205. Support
207. Aspherical micro-lenses
209. Support
211. Aspherical micro-lenses
301. Hexagonal array
303. Square array
305. Off-set square array
307. Square array with distinct focal lengths
309. Random lenses of uniform focal length/aperture
311. Random lenses of varied focal length/aperture
313. Cylindrical micro-lenses
401. Photographic Element
403. Support
407. Red sensitive layer unit
409. Interlayer
411. Green sensitive layer unit
413. Interlayer
415. Blue sensitive layer unit
417. Protective layer
419. Micro-lenses
501. Light sensitive element

503. Support
505. Antihalation layer
507. Least red sensitive layer
509. Less red sensitive layer
511. More red sensitive layer
513. Interlayer
515. Least green sensitive layer
517. Less green sensitive layer
519. More green sensitive layer
521. Interlayer
523. Least blue sensitive layer
525. Less blue sensitive layer
527. Interlayer
529. Most red sensitive layer
531. Interlayer
533. Most green sensitive layer
535. Interlayer
537. Most blue sensitive layer
539. UV and protective layer
541. Micro-lenses

What is claimed is:

1. A light sensitive photographic element comprising, in spooled form, a support, a convergent micro-lens array, and an interposed light sensitive silver halide emulsion layer unit.

2. The element of claim 1 wherein said micro-lenses have a full or partial spherical or aspherical shape.

3. The element of claim 1 wherein said micro-lenses have a full or partial cylindrical or acylindrical shape.

4. The element of claim 1 wherein the material that comprises the micro-lenses is selected so that the shape of the lenses is altered by photo processing.

5. The element of claim 1 wherein the material that comprises the micro-lenses is selected so that the shape of the lenses is not altered by photo processing.

6. The element of claim 1 wherein said micro-lenses are cylindrical portion lenses.

7. The element of claim 1 wherein said micro-lenses are acylindrical portion lenses.

8. The element of claim 1 wherein the ratio of the projected area of said micro-lenses to the projected area of said support is greater than 0.3.

9. The element of claim 1 wherein the ratio of the projected area of said micro-lenses to the projected area of said support is greater than 0.7.

10. The element of claim 1 wherein the ratio of the projected area of said micro-lenses to the projected area of said support is less than 0.9.

11. The element of claim 1 wherein the ratio of the projected area of said micro-lenses to the projected are of said support is less than 0.8.

12. The element of claim 1 wherein said micro-lens array is a geometrically ordered array.

13. The element of claim 1 wherein said micro-lens array is a geometrically non-ordered array.

14. The element of claim 1 wherein said micro-lenses have the same focal length.

15. The element of claim 1 wherein said micro-lenses have varied focal length.

16. The element of claim 1 wherein said micro-lenses have the same aperture.

17. The element of claim 1 wherein said micro-lenses have varied aperture.

18. The element of claim 1 exhibiting a photographic speed greater than ISO 400 after photo-processing.

19. The element of claim 1 having an interposed red light sensitive layer unit, an interposed green light sensitive layer unit and an interposed blue light sensitive layer unit.

20. The element of claim 19 wherein at least one of said layer units comprises at least two light sensitive layers.

21. The element of claim 19 wherein at least one of said layer unit comprises at least three light sensitive layers.

22. The element of claim 19 further comprising a non-light sensitive interposing layer.

23. The element of claim 1 wherein said micro-lens array enables at least 0.15 log E of extended photographic latitude compared to the same element without the array.

24. A method of imaging comprising the step of imagewise exposing an element according to claim 1.

25. A method of image formation comprising the step of photoprocessing an imagewise exposed light sensitive element according to claim 1.

26. The method of claim 25 comprising a development step.

27. A method of image formation comprising the step of scanning or optically printing an imagewise exposed and developed light sensitive element according to claim 1.

28. A method of imaging comprising the step of forming a digital representation of an image obtained by scanning an imagewise exposed and developed light sensitive element according to claim 1.

29. A method of imaging comprising the step of digitally altering, storing, transmitting or displaying a digital representation of an image obtained by scanning an imagewise exposed and developed light sensitive element according to claim 1.

30. An element according to claim 1 supplied in spooled form with the micro-lens face of the element wound side-in relative to a spool core.

31. An element according to claim 1 supplied in spooled form with the micro-lens face of the element wound side-out relative to a spool core.

32. A camera pre-loaded with an element according to claim 1.

33. The camera of claim 32 wherein the ratio of the camera lens f-number to the micro-lens f-number is greater than 1.4.

34. A light sensitive photographic element suitable for image capture followed by machine reading to produce a single perspective two-dimensional color image, said element comprising, in spooled form, a two-sided-support (a) having disposed on said support a red light sensitive silver halide emulsion layer unit, a green light sensitive silver halide emulsion layer unit, and a blue light sensitive silver halide emulsion layer unit, and (b) having disposed on the side of said emulsion unit opposite the support a convergent micro-lens array located and sized to be sufficient to concentrate the image light of a single perspective of an image incident on an area of a micro-lens onto a smaller area of the emulsion layer units.

35. A light sensitive photographic element suitable for image capture by a camera followed by machine reading, said element comprising, in spooled form, a two-sided support (a) having disposed on said support a red light sensitive silver halide emulsion layer unit, a green light sensitive silver halide emulsion layer unit, and a blue light sensitive silver halide emulsion layer unit, and (b) having disposed on the opposing side of the emulsion layer unit from said support a micro-lens array comprising lenses having a full or partial spherical shape located and sized to be sufficient to concentrate the camera focused image light incident on an area of a micro-lens onto a smaller area of the emulsion layer units.

36. A light sensitive photographic element exhibiting a sensitivity of at least ISO-25 and being suitable for image capture followed by machine reading, said element comprising, in spooled form, a two-sided support (a) having disposed on said support a red light sensitive silver halide emulsion layer unit, a green light sensitive silver halide emulsion layer unit, and a blue light sensitive silver halide emulsion layer unit, and (b) having disposed on the side of said emulsion layer unit opposite to said support a convergent micro-lens array located and sized to be sufficient to concentrate the image light incident on an area of a micro-lens onto a smaller area of the emulsion layer units;

whereby the sensitivity of the film is increased compared to the same film without the array.

37. A combination camera and light sensitive photographic element suitable for image capture followed by machine reading to produce a single perspective two-dimensional color image, said element comprising:

(A) a camera having a lens system for capturing a single image perspective, and (B) a support, in spooled form, having disposed thereon a red light sensitive silver halide emulsion layer unit, a green light sensitive silver halide emulsion layer unit, and a blue light sensitive silver halide emulsion layer unit, and having disposed on the side of the emulsion layer unit opposite said support a convergent micro-lens array located and sized to be sufficient to concentrate the image light from the lens system incident on an area of a micro-lens onto a smaller area of the emulsion layer units.

38. A light sensitive photographic element exhibiting a sensitivity of at least ISO-25 and being suitable for image capture followed by machine reading, said element comprising, in spooled form, a support (a) having disposed on said support a red light sensitive silver halide emulsion layer unit, a green light sensitive silver halide emulsion layer unit, and a blue light sensitive silver halide emulsion layer unit, and (b) having disposed on the side of the emulsion layer opposite said support a convergent micro-lens array located and sized to be sufficient to concentrate the image light incident on an area of a micro-lens onto a smaller area of the emulsion layer units;

whereby the latitude of the film is increased by at least 0.30 log E compared to the same film without the array.

39. An element according to claim 1 comprising a dye forming coupler.

40. A light sensitive photographic element comprising a support, a convergent micro-lens array, and an interposed light sensitive silver halide emulsion layer unit wherein the material that comprises the micro-lenses is selected so that the shape of the lenses is altered by photo processing.

* * * * *